US012551006B2

(12) United States Patent
Andersson et al.

(10) Patent No.: US 12,551,006 B2
(45) Date of Patent: Feb. 17, 2026

(54) EXTENSION TABLE

(71) Applicant: Inter IKEA Systems B.V., LN Delft (NL)

(72) Inventors: Benny Andersson, Älmhult (SE); Thomas Holma, Svängsta (SE); Markus Lindgren, Älmhult (SE); Peter Månsson, Killeberg (SE)

(73) Assignee: Inter IKEA Systems B.V., LN Delft (NL)

( * ) Notice: Subject to any disclaimer, the term of this patent is extended or adjusted under 35 U.S.C. 154(b) by 0 days.

(21) Appl. No.: 17/635,735

(22) PCT Filed: Aug. 21, 2020

(86) PCT No.: PCT/SE2020/050806
§ 371 (c)(1),
(2) Date: Feb. 16, 2022

(87) PCT Pub. No.: WO2021/034261
PCT Pub. Date: Feb. 25, 2021

(65) Prior Publication Data

US 2022/0338615 A1 Oct. 27, 2022

(30) Foreign Application Priority Data

Aug. 21, 2019 (SE) ..... 1950952-0

(51) Int. Cl.
*A47B 1/10* (2006.01)
*A47B 1/02* (2006.01)
*A47B 1/08* (2006.01)

(52) U.S. Cl.
CPC ..... *A47B 1/10* (2013.01); *A47B 1/02* (2013.01); *A47B 1/08* (2013.01)

(58) Field of Classification Search
CPC ..... A47B 1/10; A47B 1/02; A47B 1/08
(Continued)

(56) References Cited

U.S. PATENT DOCUMENTS 889,284 A 6/1908 Welterlin
2,626,844 A * 1/1953 Cooper ..... A47B 1/10 384/17
(Continued)

FOREIGN PATENT DOCUMENTS

AU 2004203810 A1 3/2005
CH 561391 A5 4/1975
(Continued)

OTHER PUBLICATIONS

PCT International Search Report for PCT Application No. PCT/SE2020/050806 mailed Sep. 30, 2020 (6 pages).
(Continued)

*Primary Examiner* — Daniel J Troy
*Assistant Examiner* — Timothy M Ayres
(74) *Attorney, Agent, or Firm* — Merchant & Gould P.C.

(57) ABSTRACT

An extension table (2) comprises a plurality of extension rails (4, 6) along the table (2) for adjusting a dimension of the table (2), wherein an extension rail (4) of the plurality of extension rails (4, 6) comprises, laterally disposed relative to each other, a middle part (4*b*); a first outer part (4*a*) connected to a first section (10) of the table (2) and slidable relative to the middle part (4*b*), a second outer part (4*c*) connected to a second section (12) of the table (2) and slidable relative to the middle part (4*b*), wherein the middle part (4*b*), the first outer part (4*a*), and the second outer part (4*c*) of the extension rail (4) each comprises an identically designed profile (106).

7 Claims, 8 Drawing Sheets

(58) Field of Classification Search
USPC ..... 108/65, 83
See application file for complete search history.

(56) References Cited

U.S. PATENT DOCUMENTS

| | | | | |
|---|---|---|---|---|
| 2,683,068 | A | 7/1954 | Beeck | |
| 2,848,291 | A | 8/1958 | Hafekost et al. | |
| 3,078,130 | A | 2/1963 | Beeck | |
| 3,097,614 | A * | 7/1963 | Duncan | A47B 1/10 108/83 |
| 3,320,003 | A * | 5/1967 | Edelson | A47B 1/10 384/42 |
| 3,336,882 | A * | 8/1967 | Edelson | A47B 1/08 108/83 |
| 3,337,274 | A * | 8/1967 | Green | A47B 1/10 312/331 |
| 3,515,077 | A * | 6/1970 | Glowacki | A47B 1/08 108/89 |
| 3,876,263 | A * | 4/1975 | Oleksiak | A47B 1/10 312/334.44 |
| 3,927,918 | A * | 12/1975 | Dobbratz | A47B 1/10 384/23 |
| 5,085,524 | A * | 2/1992 | Reiss, Jr. | A47B 1/10 108/83 |
| 6,336,743 | B1 * | 1/2002 | Wang | A47B 1/10 74/89.17 |
| 8,407,944 | B2 | 4/2013 | Baloga et al. | |
| 9,622,568 | B1 | 4/2017 | Lin | |
| 10,441,069 | B2 | 10/2019 | Andersson | |
| 11,096,479 | B2 * | 8/2021 | Mansson | A47C 17/76 |
| 2006/0032415 | A1 * | 2/2006 | Wang | A47B 1/08 108/83 |
| 2006/0117669 | A1 | 6/2006 | Baloga et al. | |
| 2007/0175131 | A1 | 8/2007 | Mueller et al. | |
| 2018/0344023 | A1 | 12/2018 | Andersson | |
| 2022/0287450 | A1 * | 9/2022 | Benard | A47B 1/10 |
| 2022/0304460 | A1 * | 9/2022 | Holma | A47B 1/02 |

FOREIGN PATENT DOCUMENTS

| | | | |
|---|---|---|---|
| CN | 2899575 | Y | 5/2007 |
| CN | 101123898 | A | 2/2008 |
| CN | 108348065 | A | 7/2018 |
| DE | 8710244 | U1 | 9/1987 |
| IT | PN20100043 | A1 | 2/2012 |
| IT | 201600127788 | A1 | 6/2018 |

OTHER PUBLICATIONS

PCT Written Opinion PCT Application No. PCT/SE2020/050806 mailed Sep. 30, 2020 (5 pages).

First Office Action dated Aug. 18, 2023 in the corresponding Chinese patent application No. 202080058326.3 (15 pages including English Translation).

Extended European Search Report dated Jul. 31, 2023 in the corresponding European application 20854811.5 (7 pages).

* cited by examiner

EXTENSION TABLE

This application is a National Stage Application of PCT/SE2020/050806, filed 21 Aug. 2020, which claims benefit of Ser. No. 1950952-0, filed 21 Aug. 2019 in Sweden, and which applications are hereby incorporated by reference in their entireties. To the extent appropriate, a claim of priority is made to each of the above disclosed applications.

FIELD OF THE INVENTION

The present inventive concept relates to an extension table.

BACKGROUND

Extension tables are tables for which one lateral dimension can be adjusted by adding or removing one or more extension leaves. They are appreciated as pieces of furniture, since they provide flexibility in the home or office. There is always a need to improve the functioning of extension tables.

SUMMARY

To this end, according to a first aspect, there is provided an extension table, comprising a plurality of extension rails along the table for adjusting a dimension of the table, wherein an extension rail of the plurality of extension rails comprises, laterally disposed relative to each other, one or more middle parts; a first outer part fixed to a first section of the table and slidable relative to the one or more middle parts, a second outer part fixed to a second section of the table and slidable relative to the one or more middle parts, wherein the one or more middle parts, the first outer part, and the second outer part of the extension rail each comprises an identically designed profile. Thus, all required functions of the extension rail of the extension table may be performed by an extension rail wherein each of the middle part, the first outer part, and the second outer part comprises an identically designed profile. Using an identically designed profile for all three parts of the extension rail simplifies manufacturing, since it reduces the number of distinct components needed.

In the case of a plurality of middle parts, each middle part may be slidable with respect to adjacent middle parts.

The profile of the first outer part and each profile of the one or more middle parts may each contain a sliding member, wherein each sliding member is fixed to an adjacent profile. Thus, for example, in the case of one middle part, the sliding member of the first outer part may be fixed to the profile of the middle part, and the sliding member of the middle part may be fixed to the profile of the second outer part. In the case of a plurality of middle parts, the sliding member of the first outer part may be fixed to the profile of the adjacent middle part and the sliding member of each middle part may be fixed to the profile of the next adjacent middle part, or the case of the last middle part, to the profile of the second outer part.

The profile may be made from bent sheet metal, which provides a stiff profile that still is easy to manufacture.

The profile may comprise a space for containing the respective sliding member, wherein the space is open, longitudinally along the profile, exclusively to one lateral side of the profile, while an opposite lateral side of the profile comprises a wall. This allows for space for a sliding member and for space to connect the sliding member to another part of the extension rail.

The profile may comprise a tubular structurally reinforcing section. The tubular structurally reinforcing section may be located above the space for containing the respective sliding member. This combines structural reinforcement with space for a plug for attaching the section to the tabletop.

The first section of the table may be fixed to the first outer part through the tubular structurally reinforcing section of the profile of the first outer part and the second section of the table is fixed to the second outer part through the tubular structurally reinforcing section of the profile of the second outer part.

The sliding member of the first outer part may be fixed to the wall of the adjacent profile. Thus, for example, in the case of one middle part, the sliding member of the first outer part may be fixed to the wall of the profile of the middle part, and the sliding member of the middle part may be fixed to the wall of the profile of the second outer part. In the case of a plurality of middle parts, the sliding member of the first outer part may be fixed to the wall of the profile of the adjacent middle part and the sliding member of each middle part may be fixed to the wall of the profile of the next adjacent middle part, or the case of the last middle part, to the wall of the profile of the second outer part.

The profile may comprise, on the same lateral side on which the space is open, a pair of opposing vertical protrusions for keeping the sliding member in the space.

According to a second aspect, there is provided an extension table, comprising a first extension rail and a second extension rail, each extending transversally along the table for adjusting a dimension of the table, wherein the first extension rail comprises a first horizontal surface extending towards the second extension rail; and the second extension rail comprises a second horizontal surface extending towards the second extension rail, so that an extension leaf may be stored between the first extension rail and the second extension rail, resting on the first horizontal surface and the second horizontal surface, wherein each of the first horizontal surface and the second horizontal surface is comprised in an "L"-shaped profile installable by sliding the "L"-shaped profile into a profile comprised in the respective extension rail.

This provides a convenient way of storing one or more extension leaves not used for the moment.

The profile of the extension rail may comprise a pair of opposing vertical protrusions, the "L"-shaped profile having protrusions matching the pair of opposing vertical protrusions for keeping the "L"-shaped profile in place.

BRIEF DESCRIPTION OF THE DRAWINGS

The above, as well as additional objects, features and advantages of the present inventive concept, will be better understood through the following illustrative and non-limiting detailed description of preferred embodiments, with reference to the appended drawings, where the same reference numerals will be used for similar elements, wherein.

DETAILED DESCRIPTION

Figure 1:
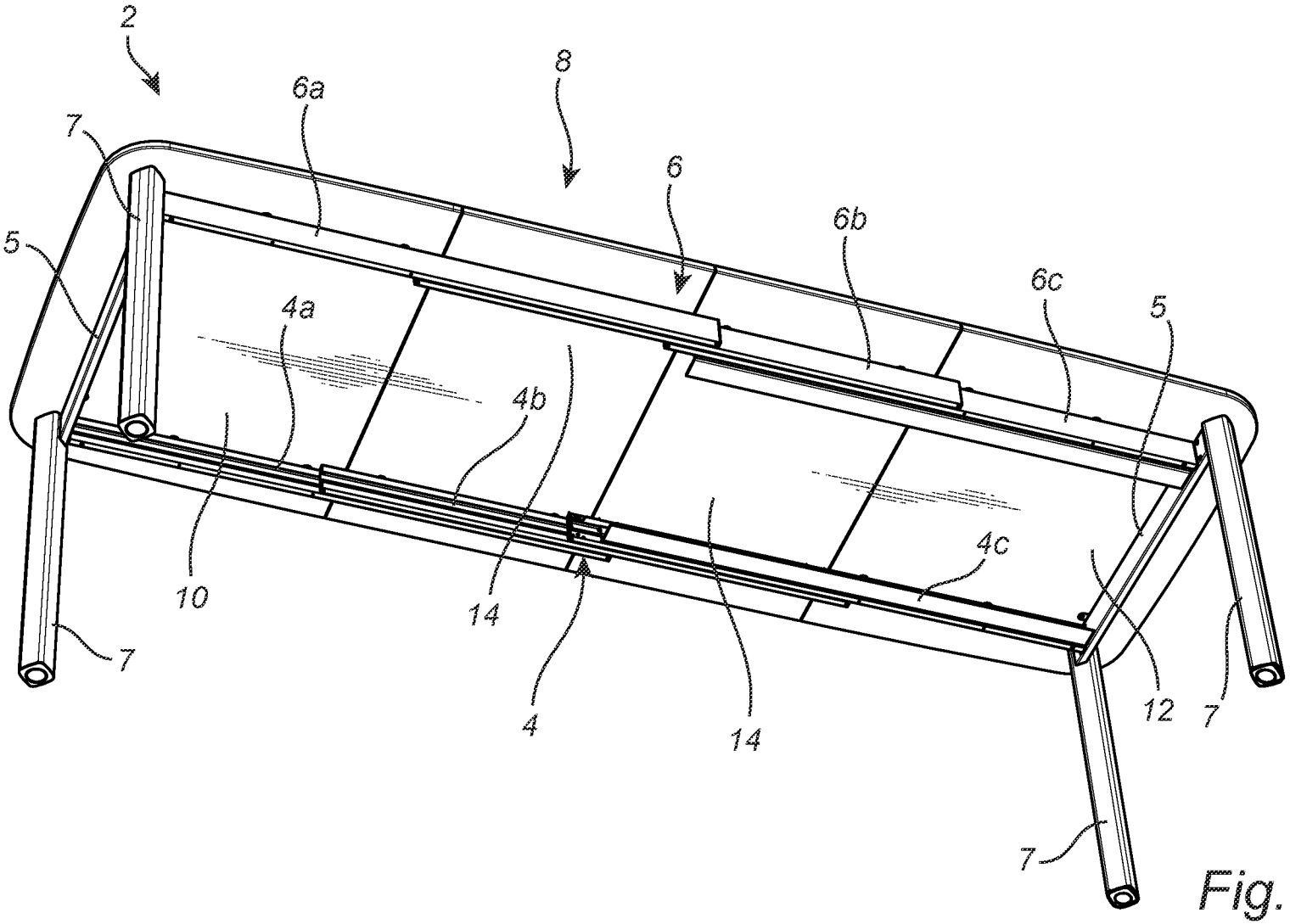
FIG. 1 shows a perspective view of an extension table with a first extension rail and a second extension rail.

FIG. 1 shows an extension table 2.

The extension table 2 comprises a first extension rail 4 and a second extension rail 6, each extending along the length of the table 2 for adjusting the length of the table 2. Each extension rail 4, 6 may comprise three or more parts—as depicted three parts 4*a*/6*a*, 4*b*/6*b*, 4*c*/6*c*—slidable against each other for adjusting the length of the respective extension rail 4, 6, and thus of the table 4.

The extension rails 4, 6 are at each of their respective ends connected to each of two rigid short sections 5, so that each of the short sections 5 and the first extension rail 4 and the second extension rail 6 form a rectangular frame on which a tabletop 8 rests. At each of the four corners of the frame, a respective table leg 7 is attached to the frame.

Each of the extension rails 4, 6 may be made of metal.

The tabletop 8 of the table 2 is formed by a first, fixed, section 10 at a first short end of the table 2, a second, fixed, section 12 at a second short end of the table 2, and, optionally at the point of use, one or more extension leaves 14—as depicted two extension leaves 14—positionable to rest on the first 4 and second 6 extension rails between the first section 10 and the second section 12.

Figures 2A, 2B:
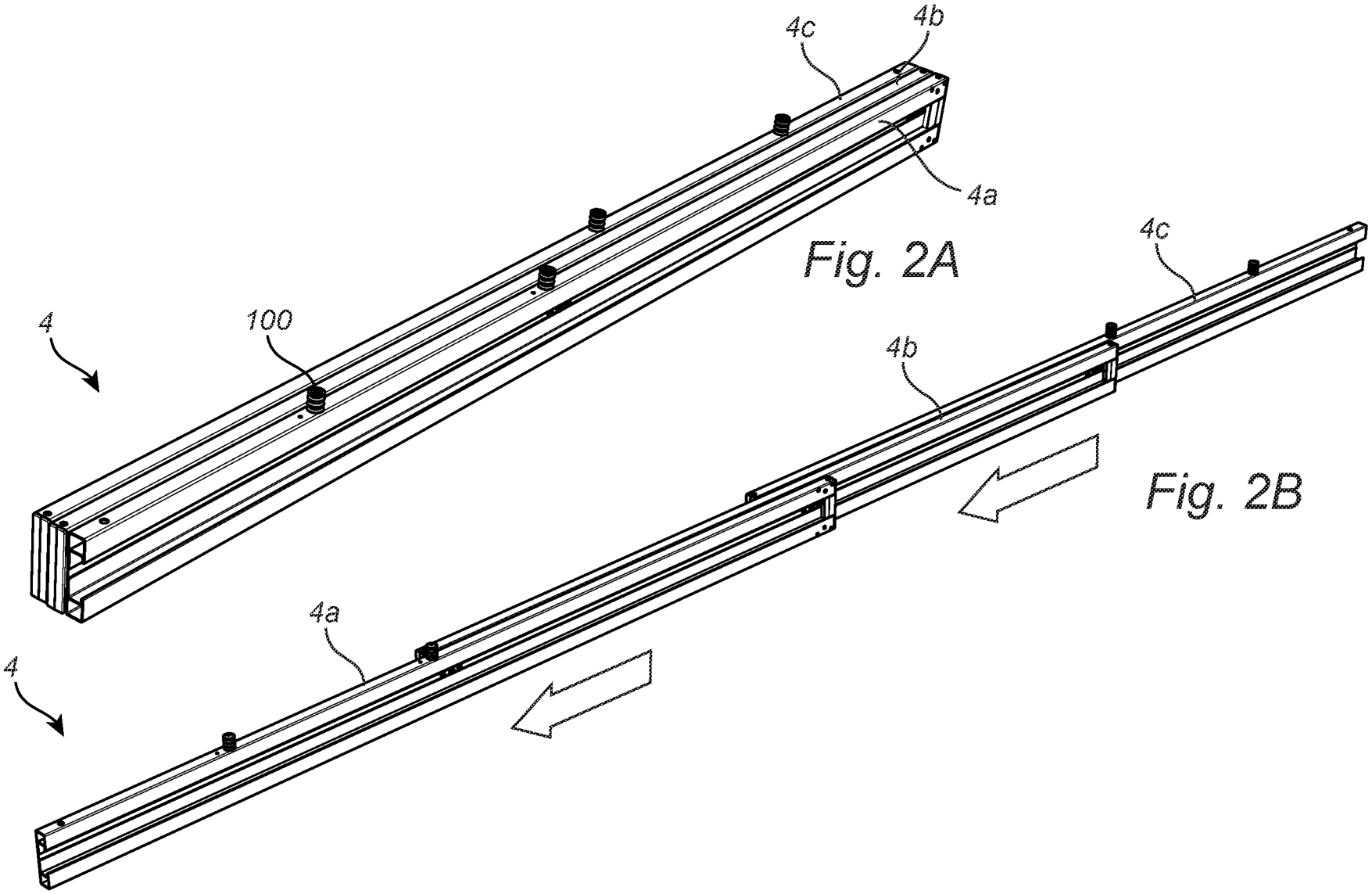
FIGS. 2A and 2B show, in perspective views, close-ups of an extension rail.

FIGS. 2A and 2B show the first extension rail 4 isolated and in detail. All features and effects described throughout this disclosure for the first extension rail 4 equally apply to the second extension rail 6.

The extension rail 4 comprises, laterally disposed relative to each other, a middle part 4*b*, a first outer part 4*a*, and a second outer part 4*c*.

The first a first outer part 4*a* of the extension rail 4 is connected to and fixed to the first section 10 of the table 2 (cf. FIG. 1), through two plugs 100 and the second outer part 4*c* of the extension rail 4 is connected to and fixed to the second section 12 of the table 2 through two different plugs 100.

Both the first outer part 4*a* and the second outer part 4*c* are slidable relative to the middle part 4*b*, as shown by arrows in FIG. 2B. Through the sliding, the length of the table 2 may be adjusted and extension leaves 14 (cf. FIG. 14) added or removed according to need. FIG. 2A shows a retracted configuration of the extension rail 4, corresponding to no extension leaves 14 (cf. FIG. 1) present, while FIG. 2B shows an extended configuration of the extension rail 4.

Figure 3:
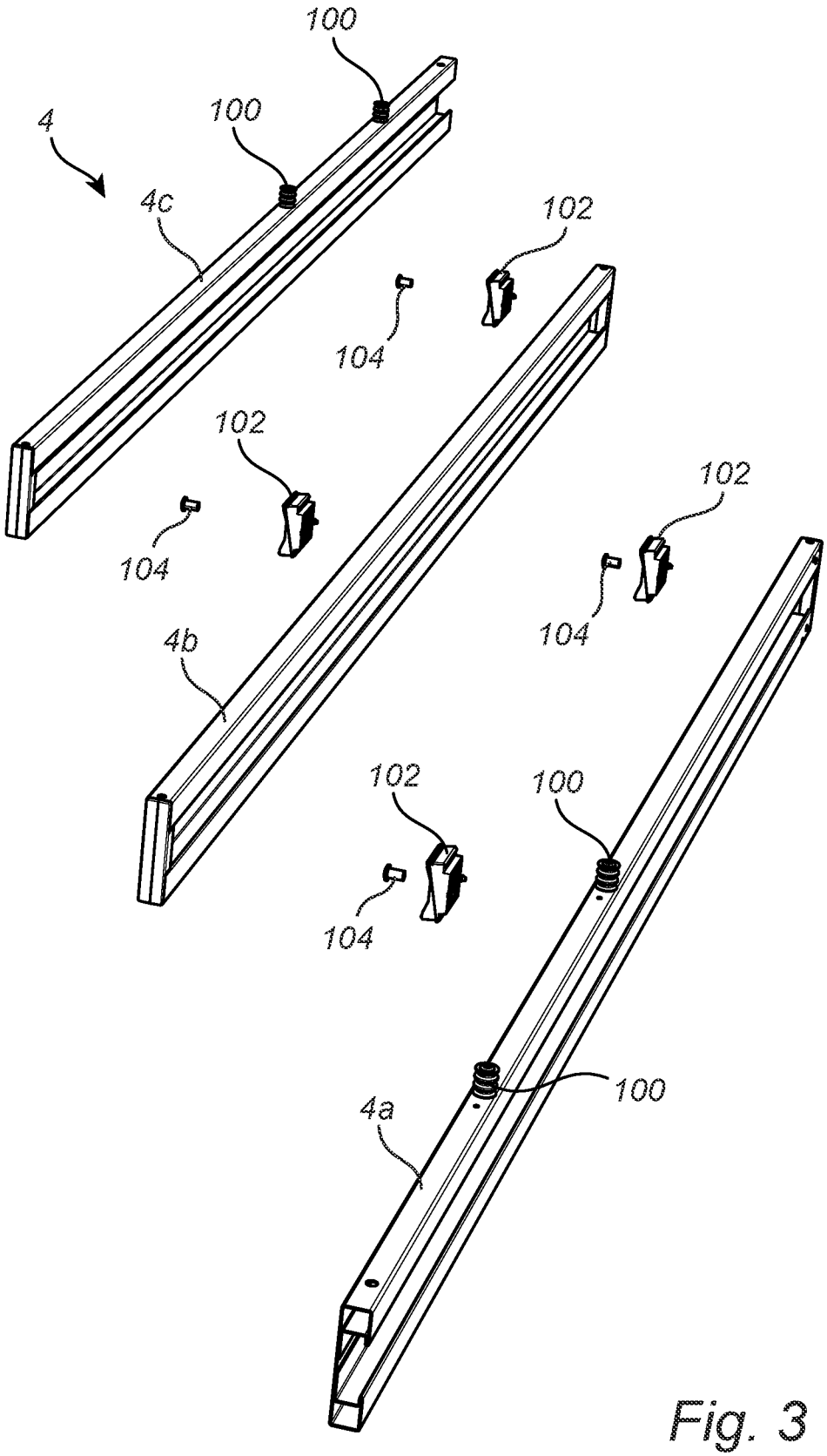
FIG. 3 is an exploded view of the extension rail.

FIG. 3 is an exploded view showing how the first outer part 4*a*, the middle part 4*b* and the second outer part 4*c* fit together to form the first extension rail 4. The middle part 4*b*, the first outer part 4*a*, and the second outer part 4*c* of the extension rail 4 each comprises an identically designed profile 106. The second extension rail 6 has corresponding and identical features. The profile 106 may be made from bent sheet metal.

The profile 106 of the first outer part and the profile 106 of the middle part each contains at least one sliding member 102—as depicted two sliding members 102—slidable against the respective profile 106, allowing the first outer part 4*a* to be slidable against the middle part 4*b* and the middle part 4*b* to be slidable against the second outer part 4*c*. The sliding member 102 of the first outer part 4*a* is fixed to the profile 106 of the middle part 4*b* though a plug 104 fitting into a hole in the profile 106 of the middle part 4*b*, and the sliding member 102 of the middle part 4*b* is fixed to the second outer part 4*c* through a different plug 104 fitting into a hole in the profile 106 of the second outer part 4*c*.

Figure 4:
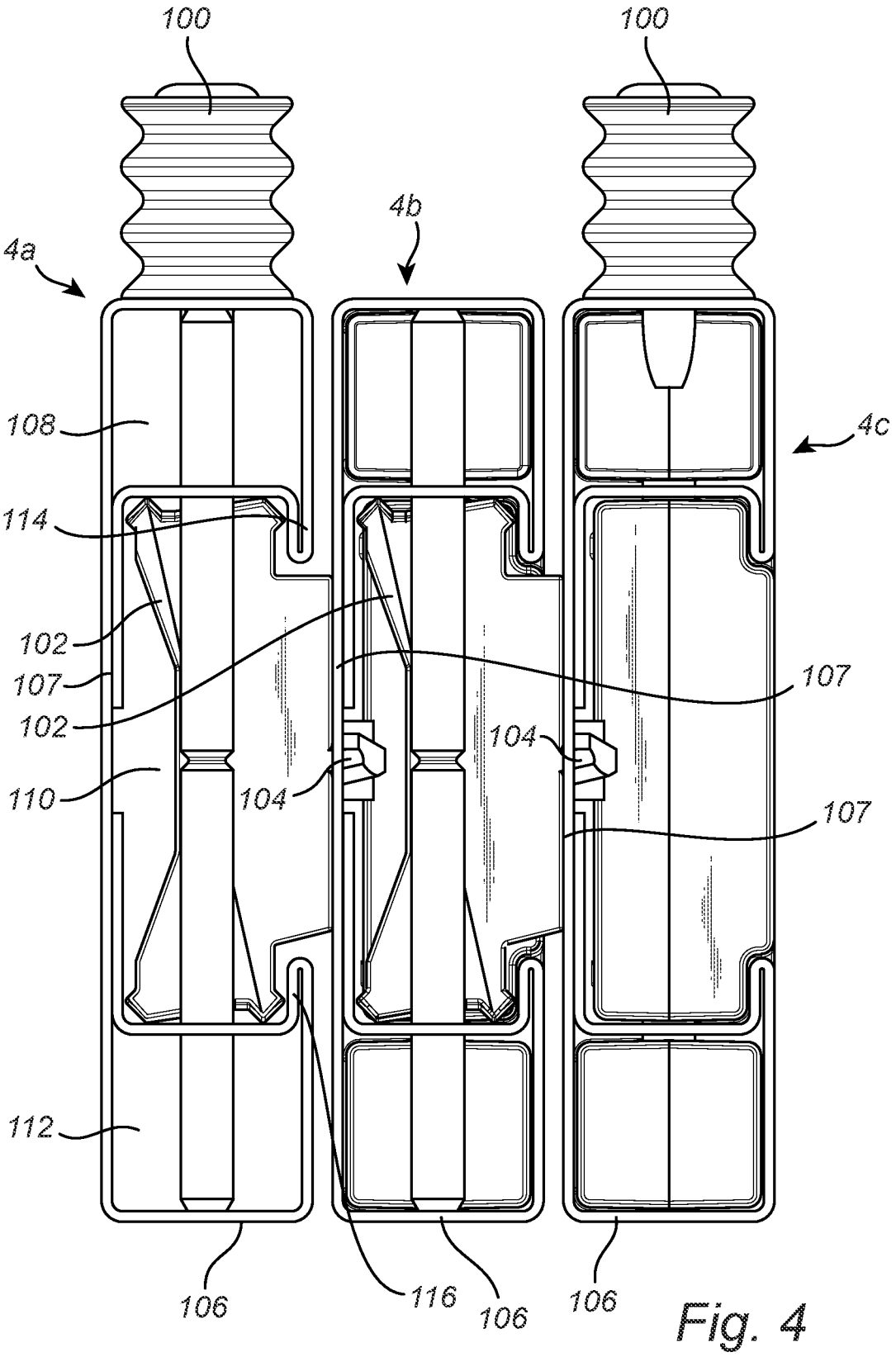
FIG. 4 is a cross-sectional view of the extension rail.
Figure 5:
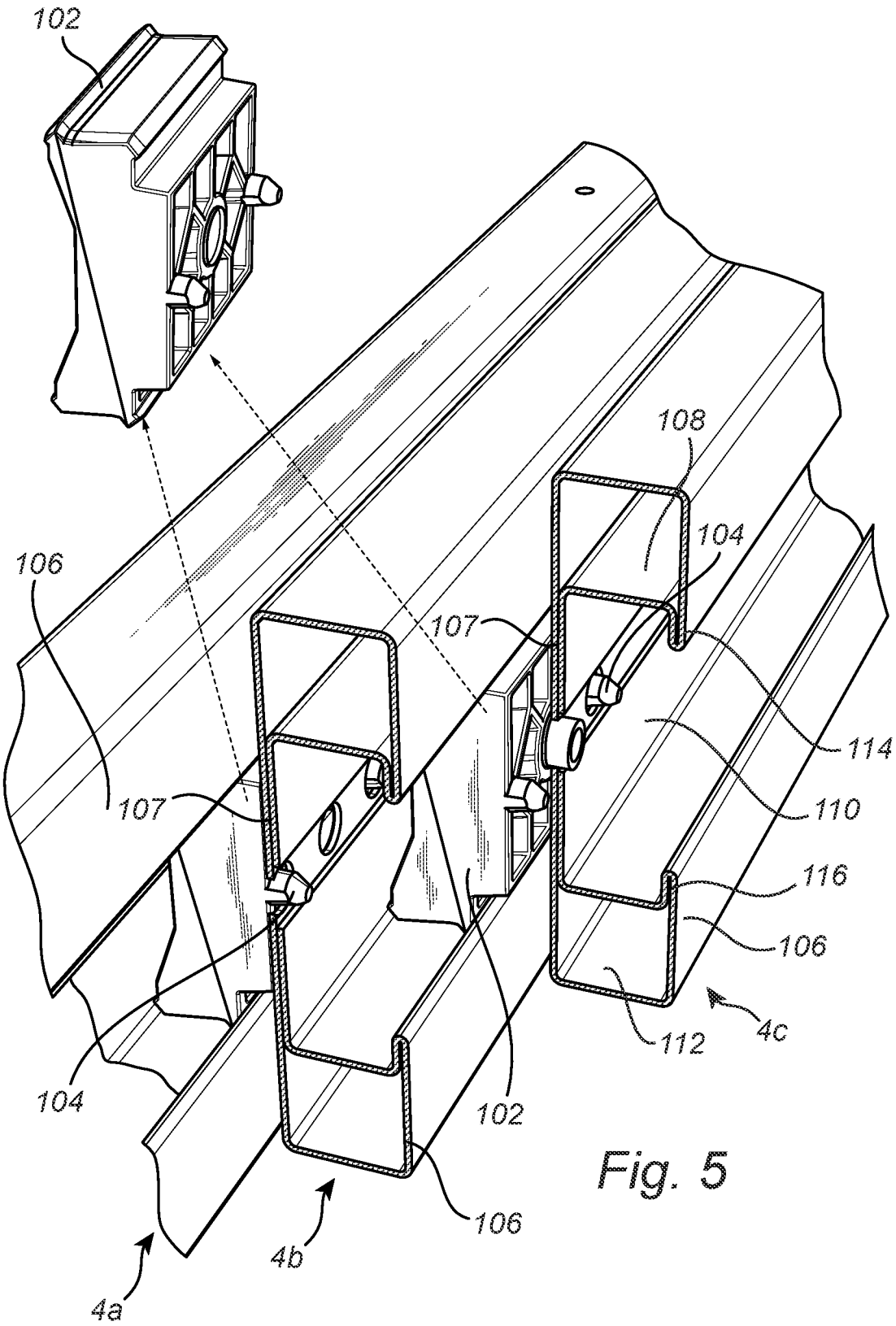
FIG. 5 is a perspective and cross-sectional view of the extension tail.

FIGS. 4 and 5 show a cross sections of the extension rail 4, including each of the three identical profiles 106 of, respectively, the first outer part 4*a*, the middle part 4*b*, and the second outer part 4*c*.

Each of the profiles 106 may, as depicted, comprise a main space 110 open, longitudinally along the profile 106, exclusively to one lateral side of the profile—as depicted to the right side—while an opposite lateral side of the profile, as depicted the left side, comprises a wall 107. The sliding members 102 of the first outer part 4*a* and of the middle part 4*b* are contained in the respective main space of the respective profile 106.

As depicted, the sliding member 102 of the first outer part 4*a* may be fixed to the wall 107 of the profile of the middle part 4*b* through a plug 104, and the sliding member 102 of the middle part 4*b* may be fixed to the wall 107 of the profile 106 of the second outer part 4*c* through another plug 104.

The profile 106 may comprise, on the same lateral side on which the space is open, a pair 114, 116 of opposing vertical protrusions for keeping the sliding member 112 in the space. The protrusions may, as depicted, comprise bends in the bent sheet metal of the profile 106.

Above and below the main space, there, may, as depicted, exist a respective upper 108 and lower 112 closed tubular reinforcing section. Each closed tubular reinforcing section 108, 112 may have, as depicted, a square cross section. The first fixed part 10 of the table 2 (cf. FIG. 1) may be connected and fixed to the first outer part 4*a* of the extension rail 4 through the upper tubular structurally reinforcing section of the profile 106 of the first outer part 4*a* through a plug 100 and the second fixed part 12 of the table 2 may be connected and fixed to the second outer part 4*c* of the extension rail 4 through the upper tubular structurally reinforcing section 108 of the profile 106 of the second outer part 4*c*.

Sliding may, as depicted, occur through direct contact between the material of the sliding member 112 and the profile 106, or, for example, through wheels or similar.

Figure 6:
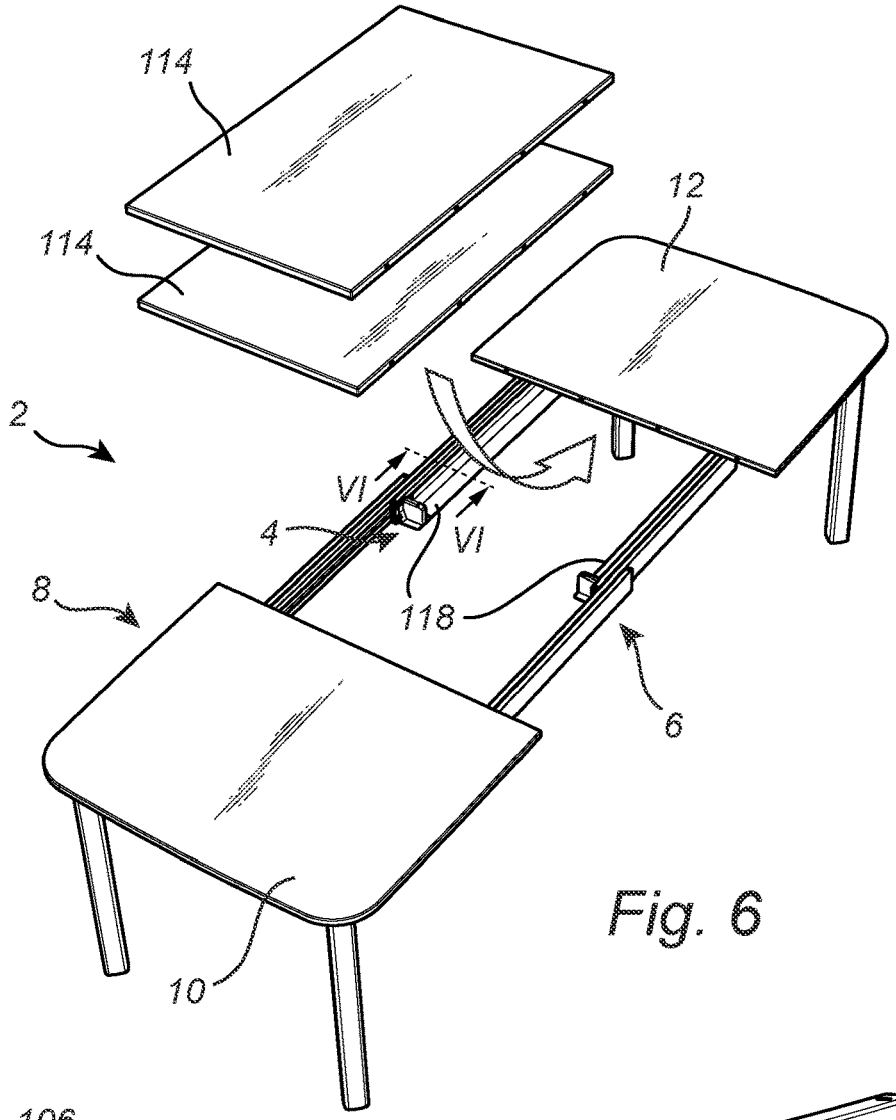
FIG. 6 is a perspective view showing storage of one or more extension leaves.
Figure 7:
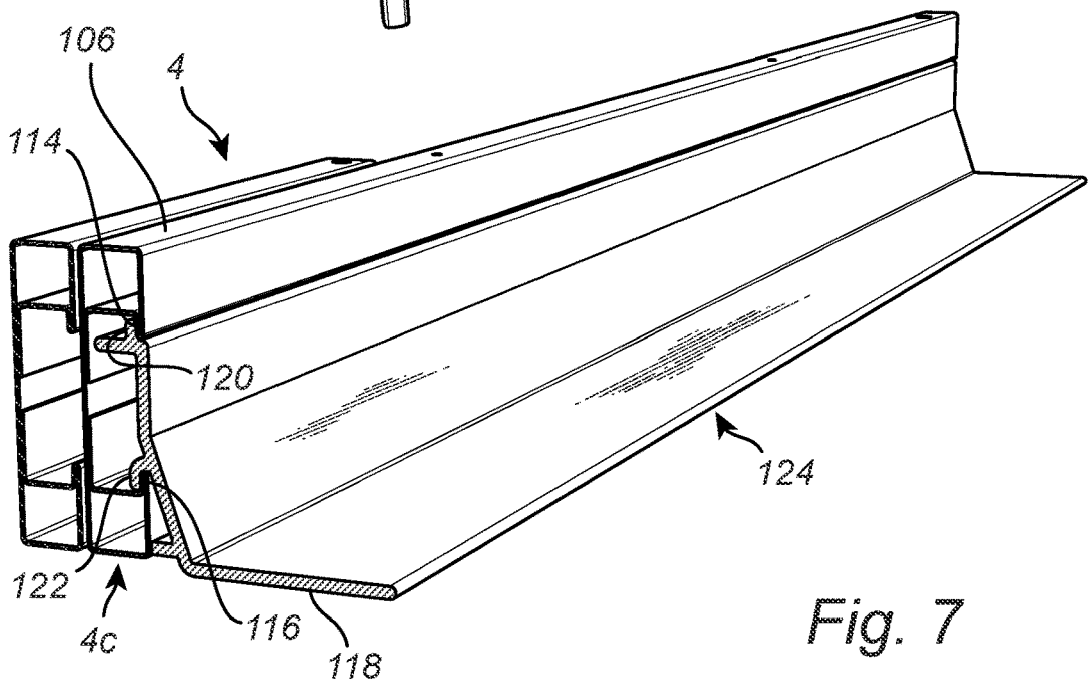
FIG. 7 is a perspective view showing an "L"-shaped profile used for storage of the one or more extension leaves.
Figure 8:
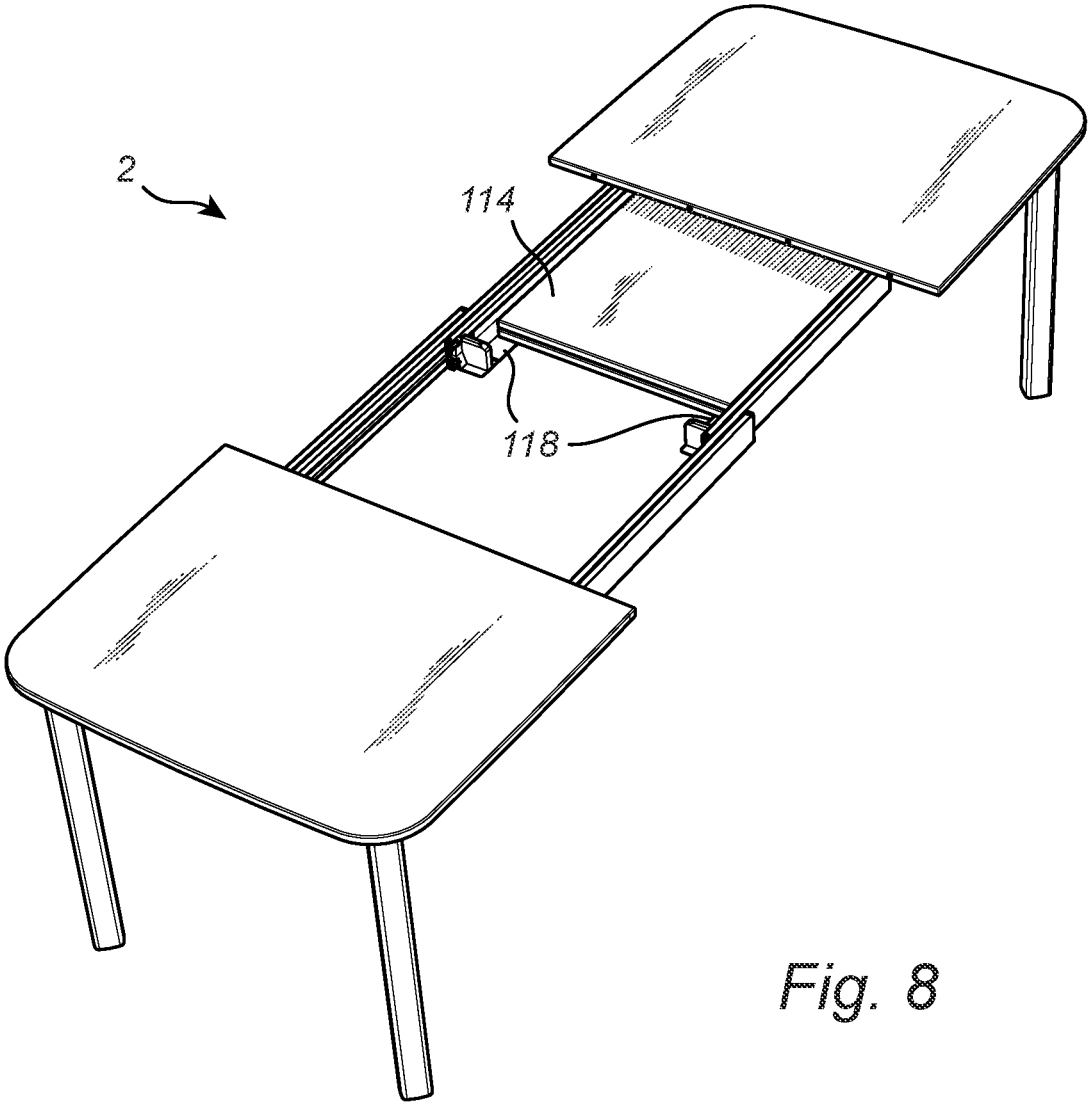
FIG. 8 is a perspective view showing extension leaves stored according to FIGS. 6 and 7.

FIGS. 6, 7, and 8 show a configuration where the first extension rail 4, in addition to what has been detailed above in conjunction with FIGS. 1-5, comprises a first horizontal surface 118 extending towards the second extension rail 6; and the second extension rail 6 comprises a second horizontal surface 118 extending towards the first extension rail 4, so that one or more extension leaves 114 may be stored, as indicated by an arrow in FIG. 6, and shown in FIG. 8, between the first extension rail 4 and the second extension rail 6, resting on the first horizontal surface 118 of the first extension rail 4 and the second horizontal surface 118 of the second extension rail 6. After the user placing the one or more extension leaves on top of the first and second horizontal surfaces 118, the first section 10 and the second section 12 may be brought together through sliding the extension rails 4, 6, so that the one or more extension leaves 114 rest out of view below the tabletop 8 formed by the first section 10 and the second section 12.

As can be seen in FIG. 7, the first horizontal surface is comprised in a first "L"-shaped profile 124 installable by sliding the "L"-shaped profile 124 into the profile 106 of the second outer part 4*c* of the extension rail. The vertical protrusions 114 and 116 of the profile 106 abut matching protrusions 120 and 122 of the "L"-shaped profile 124, keeping the "L"-shaped profile 124 in place.

In the same way (not depicted in FIG. 7), the horizontal surface 118 of the second extension rail 6 is formed by a second "L"-shaped profile installable into the profile 106 of a second outer part of the second extension rail 6.

Figure 9:
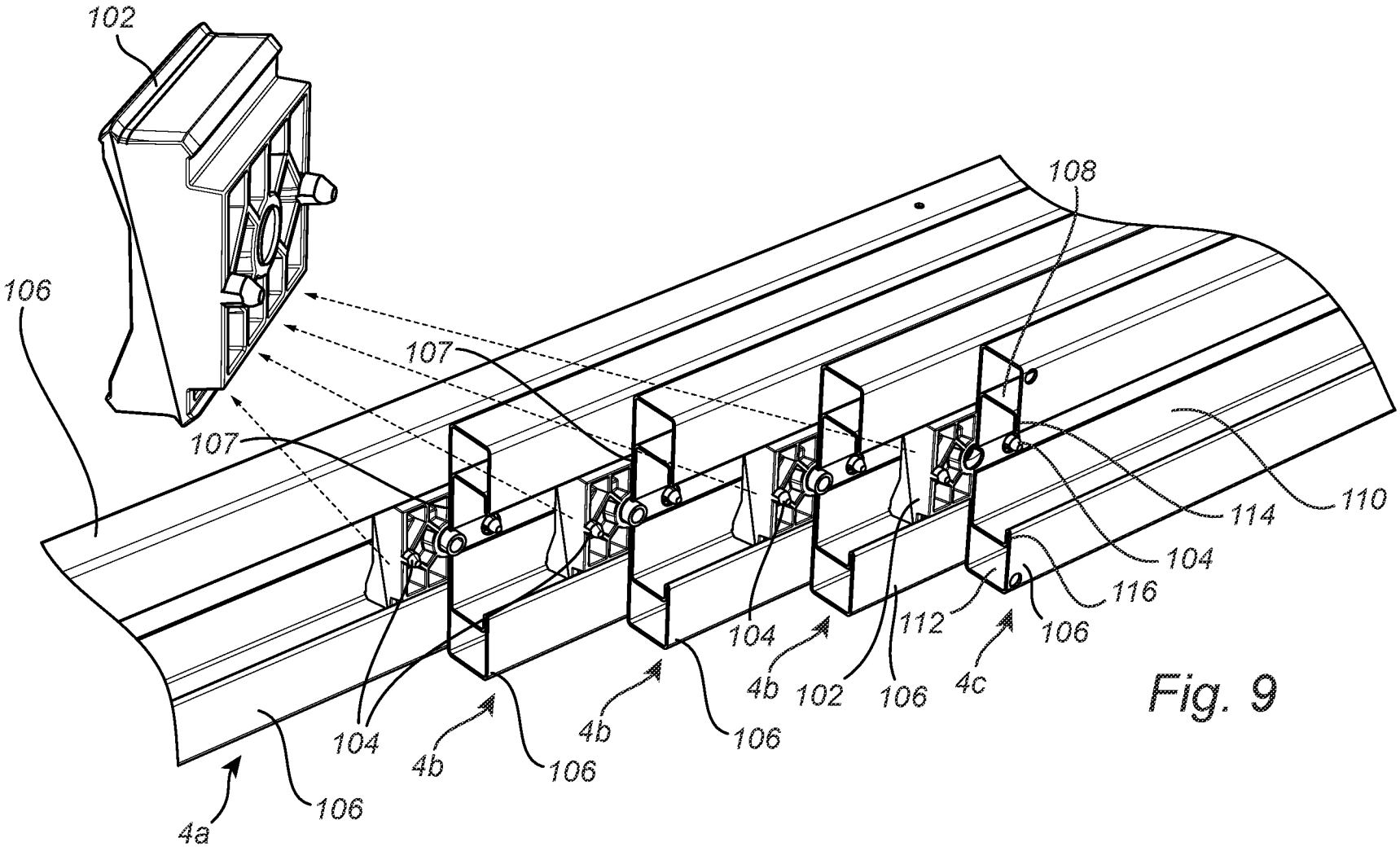
FIG. 9 is a perspective view of the extension rail showing multiple middle parts.

FIG. 9 is a perspective view of an alternative embodiment of the extension rail 4. In this embodiment, the extension rail 4 has a plurality of middle parts 4*b*. In the particular embodiment shown in FIG. 9 the extension rail 4 has three middle parts 4*b* that are positioned between the first outer part 4*a* and the second outer part 4*c*.

The inventive concept has mainly been described above with reference to example embodiments. However, as is readily appreciated by a person skilled in the art, other embodiments than the ones disclosed above are equally possible within the scope of the inventive concept, as defined by the appended patent claims.

The invention claimed is:

1. An extension table comprising a plurality of extension rails along said table for adjusting a dimension of said table, wherein each of said plurality of extension rails comprises:

one or more middle parts;

a first outer part fixed to a first section of said table and slidable relative to said one or more middle parts;

a second outer part fixed to a second section of said table and slidable relative to said one or more middle parts;

wherein each of said one or more middle parts, said first outer part, and said second outer part of said extension rail are laterally disposed relative to each other and have an identical profile, wherein said profile defines a main space and a wall, and wherein the wall extends along a top of the main space, a bottom of the main space, and a side of the main space, wherein said profile defines a closed tubular reinforcing section located above or below the main space, wherein said profile of said first outer part and said profile of said one or more middle parts contains a sliding member located within the main space, and the main space comprising an opening in a direction away from the wall extending along a side of the main space, wherein the opening of each profile faces in a same direction, and wherein each of said sliding member is fixed to said profile wall of an adjacent profile through the opening of the main space in which the sliding member is located.

2. The extension table of claim 1, wherein said profile is made from bent sheet metal.

3. The extension table of claim 1, wherein said closed tubular structurally reinforcing section is located above said space for containing the respective sliding member.

4. The extension table of claim 1, wherein said first section of said table is fixed to said first outer part through said tubular structurally reinforcing section of said profile of said first outer part and said second section of said table is fixed to said second outer part through said tubular structurally reinforcing section of said profile of said second outer part.

5. The extension table of claim 1, wherein said profile comprises, on the same lateral side on which said space is open, a pair of opposing vertical protrusions for keeping said sliding member in said space.

6. The extension table of claim 1, wherein said profile comprising a plurality of middle parts, wherein each middle part is slidable with respect to an adjacent middle part.

7. The extension table of claim 1, wherein the closed tubular reinforcing section has a square cross section.

* * * * *